United States Patent [19]

Brummans et al.

[11] Patent Number: 4,934,947

[45] Date of Patent: Jun. 19, 1990

[54] MODULAR JACK FOR FLAT FLEXIBLE CABLE

[75] Inventors: Wilhelmus J. Brummans, Cornelus A.H.M. Sterken, Saint-Michielsgestel, both of Netherlands

[73] Assignee: AMP Incorporated, Harrisburg, Pa.

[21] Appl. No.: 415,409

[22] Filed: Sep. 29, 1989

Related U.S. Application Data

[63] Continuation of Ser. No. 261,203, Oct. 21, 1988, abandoned.

[30] Foreign Application Priority Data

Oct. 30, 1987 [GB] United Kingdom ..... 8725475

[51] Int. Cl.[5] ..... H01R 9/09

[52] U.S. Cl. ..... 439/77; 439/324; 439/492; 439/676

[58] Field of Search ..... 439/77, 329, 453, 460, 439/463, 492, 494, 676

[56] References Cited

U.S. PATENT DOCUMENTS

| | | | |
|---|---|---|---|
| 3,149,896 | 9/1964 | Hall | 439/329 |
| 3,989,336 | 11/1976 | Rizzo, Jr. et al. | 439/329 |
| 4,130,330 | 12/1978 | Chandler | 339/75 M |
| 4,193,654 | 3/1980 | Hughes et al. | 339/17 LC |
| 4,210,376 | 7/1980 | Hughes et al. | 339/17 LC |
| 4,367,006 | 1/1983 | Rehbogen, Jr. et al. | 339/176 MF |
| 4,373,766 | 2/1983 | Johnston | 439/460 |
| 4,477,141 | 10/1984 | Hardesty | 339/122 R |
| 4,516,822 | 5/1985 | Wolfel | 339/103 M |
| 4,602,842 | 7/1986 | Free et al. | 439/676 |
| 4,629,266 | 12/1986 | Viselli | 339/17 LC |
| 4,630,874 | 12/1986 | Renn et al. | 439/492 |
| 4,647,136 | 3/1987 | Kinoshita et al. | 439/571 |
| 4,688,875 | 8/1987 | O'Connor | 439/676 |
| 4,695,115 | 9/1987 | Talend | 439/676 |
| 4,703,991 | 11/1987 | Philippson | 439/676 |
| 4,718,859 | 1/1988 | Gardner | 439/329 |
| 4,808,113 | 2/1989 | Kanesige et al. | 439/77 |

FOREIGN PATENT DOCUMENTS

| | | | |
|---|---|---|---|
| 2129150 | 12/1971 | Fed. Rep. of Germany | 439/77 |
| 1237194 | 9/1969 | United Kingdom . | |
| 1488328 | 5/1976 | United Kingdom . | |
| 2008333 | 10/1978 | United Kingdom . | |
| 2169156 | 12/1985 | United Kingdom . | |
| 2175152 | 4/1986 | United Kingdom . | |

*Primary Examiner*—P. Austin Bradley

*Attorney, Agent, or Firm*—Bruce J. Wolstoncroft

[57] ABSTRACT

An electrical receptacle (2) is disclosed which includes resilient contact portions (72) for interconnection to a plug, and includes cantilever beam portions (74) which are interconnectable with conductors (124) of flat flexible cable (120). The receptacle (2) also includes an insulating block (90) which has ratchet teeth (96) which are complementary with ratchet teeth (16) on the housing sidewalls (14). The insulating block is movable towards the terminal support platform (10) of the housing (4) for maintaining the electrical connection between the conductors (124) and the centilever beam portions (74).

7 Claims, 2 Drawing Sheets

100
92
90
98
20
92
18
14
16
12
14
10
70
120
124
22
6
8
4
6
2
122

74
122
26
12
30
46
124
28
32
34
22
72
8
42
48
50
40

MODULAR JACK FOR FLAT FLEXIBLE CABLE

This application is a continuation of application Ser. No. 07/261,203, now abandoned, filed 10/21/88.

The subject invention relates to a modular connector receptacle which is matable with a modular plug and with the conductors of flat flexible cable.

U.S. Pat. No. 4,261,633 shows a modular receptacle, typically known as a modular jack, which is matable with a modular plug. The modular jack shown in U.S. Pat. No. 4,261,633 has an insulative housing and a plurality of electrical terminals therein where the electrical terminals have resilient contact portions and conductor connecting portions. An insulating block is included which is movable towards the conductor connecting portions of the terminals to move conductors into electrical engagement therewith. The conductors, which are movable into electrical engagement with the terminals, are discrete insulated conductors.

The subject invention is an electrical connector and more particularly an electrical receptacle and is characterized by a housing which includes a terminal support platform which houses the terminals in side-by-side arrangement and the housing includes two side walls which upstand from the platform and flank the terminal support platform. The side walls and the insulating block each include complementary ratchet teeth for progressive locking arrangement of the conductors with the conductor connecting portions.

An electrical connector is shown in U.S. Pat. No. 4,367,006 which electrically interconnects conductors of flat flexible cable to a plurality of second conductors. The connector includes an insulative housing having a terminal receiving platform with a plurality of terminals aligned side-by-side along the platform for contact with the conductors of the flat flexible cable.

The instant invention, however is characterized by the terminal receiving platform of the insulative housing which is profiled for receiving the conductors of the flat flexible cable towards the surface of the platform and includes side-by-side grooves for receiving the terminals. Each of the terminals has a cantilever beam portion which projects above a surface of the platform for interconnection to respective facing conductors of the flat flexible cable. The connector also includes means to move the flat flexible cable into fixed registration with the cantilever beam portions of the terminals.

The preferred embodiment of the invention will now be described in view of the drawings in which:

FIG. 3 is a rear plan view of the jack showing the plug receiving opening.

Figure 1:
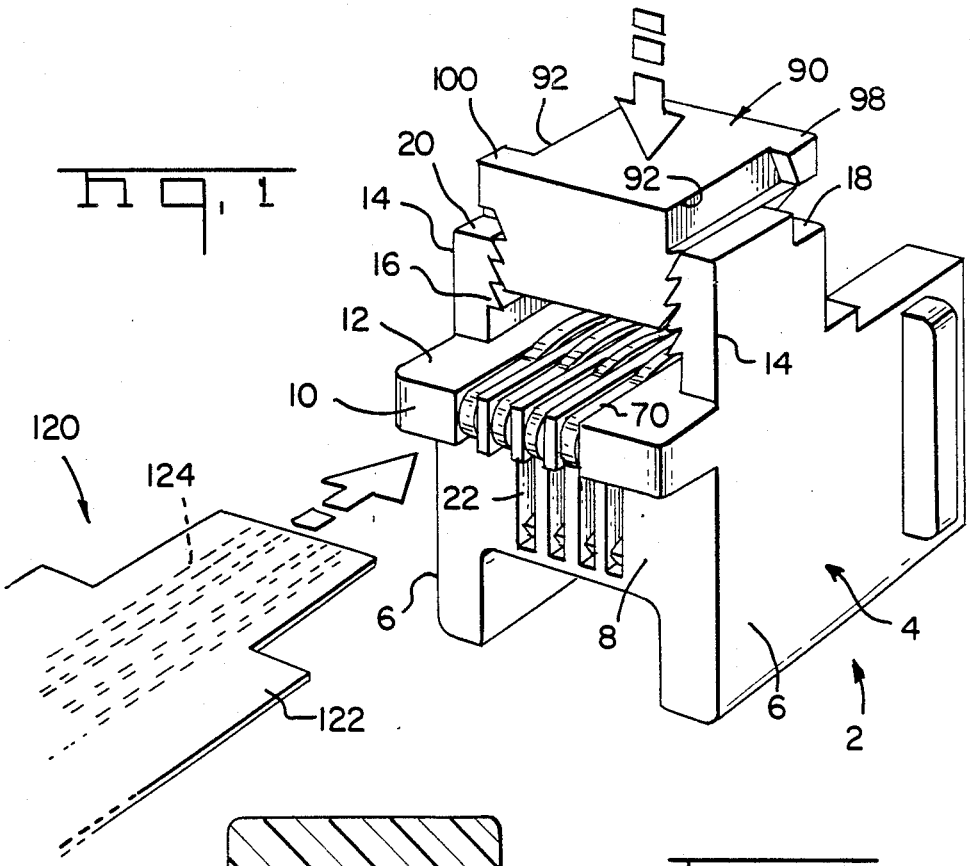
FIG. 1 shows an isometric view of the modular jack showing the flat flexible cable poised for receipt within the jack.

Referring first to FIG. 1, the jack 2 of the instant invention generally includes an insulative housing 4 having a plurality of electrical terminals, such as 70, and an insulating block 90 which latchably maintains the conductors of a flat flexible cable 120 in electrical interconnection with the terminals 70.

Figure 2:
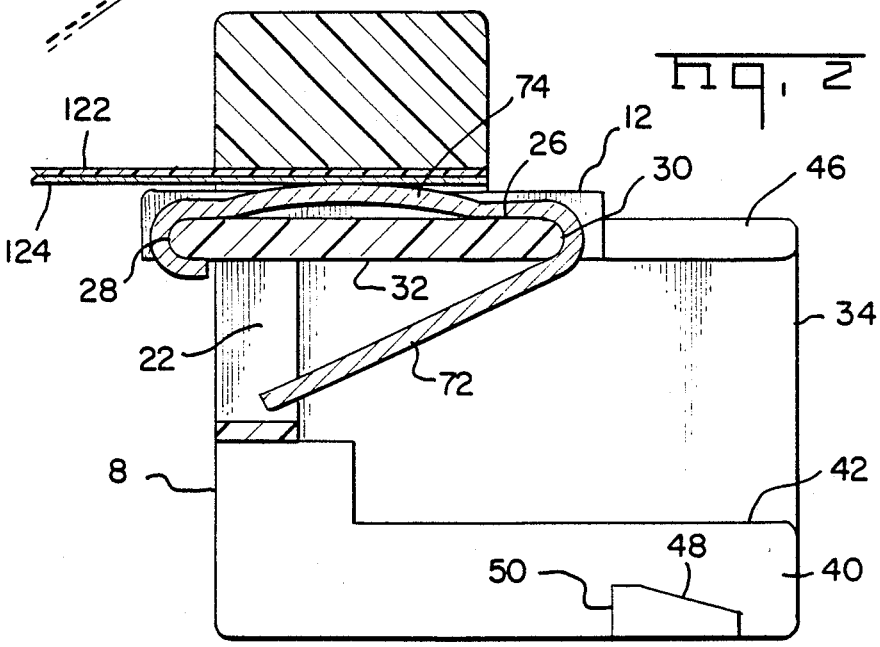
FIG. 2 is a cross-sectional view through lines 2—2 of FIG. 3.
Figure 7:
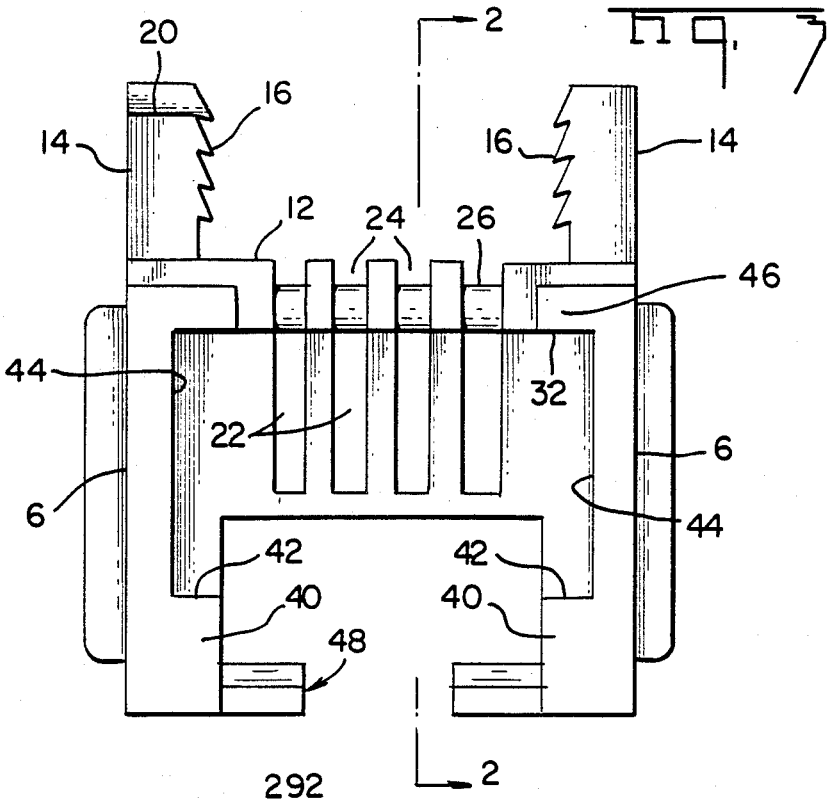

The insulative housing 4 generally includes two side walls 6 with a front mating face 8. A top wall or terminal support platform 10 is included which extends from a position forward of the front face 8 rearward towards the plug receiving face 34. The top surface 12 of the platform 10 includes a plurality of grooves 24, as shown in FIG. 3, having a top surface 26 and, as shown in FIG. 2, includes a front radiused portion 28 and a rear radiused portion 30. An inner surface 32 of the top wall 10 is coplanar with recessed walls 46. Two lower walls 40 extend at least partially between the sidewalls 6 and include an upper shoulder 42 and a latching member, such as 48, having a rear latching surface 50.

The housing 4 further includes a pair of sidewalls 14 which upstand from the terminal support platform 10 and flank the grooves 24 which receive the terminals 70. Each of the side walls 14 includes on their inner surfaces ratchet teeth 16 which are complementary and latchable with ratchet teeth 96 on an insulating block 90. Insulating block 90 further includes side walls 92 and stop blocks 98, 100. Side walls 14 include recessed stop surfaces 18, 20.

Advantageously then, the housing 4 as described above, can be molded from a single draw mold which simplifies the molding procedures and improves production capabilities, as more mold cavities can be included per mold machine.

A plurality of terminals, such as 70, are included which include cantilever beam portions 74 and reversely bent contact portions 72. Each of the terminals 70 is disposed within the insulative housing 4 in a side-by-side relation on the terminal support platform 10 and aligned in one of the grooves 24. At the forward end, the terminal 70 is curled around the radiused portion 28 and the end of the electrical terminal is reversely bent around the second radiused portion 30 to define the reversely bent contact portion 72. As shown in FIG. 2, the ends of the reversely bent contact portions project into the windows 22 which retain the reversely bent contact portions in lateral alignment for receipt of the electrical plug member. It should be noted that the upper extent of the cantilever beam portion projects above the top surface 12 of the terminal support platform 10 for mating engagement with the conductors of the flat flexible cable.

As shown in FIG. 3, the plug receiving opening is defined by the inner surfaces 44 of the side walls 6, the upper surfaces 42 of the lower walls 40 and by the upper surface 32. This defines a rectangular opening for receiving the modular plug while the latching means 48 is included for engagement with the resilient latch of the modular plug.

As shown in FIG. 1, the flat flexible cable has conductors 124 applied to the insulating material 122, and is insertable into the front of the connector 2 with the conductors 124 facing the terminal support platform 10. When the conductors are laterally aligned with the cantilever beam portions 74 of the terminals 70, the insulating block 90 can be pushed downwardly and the complementary ratchet teeth can latchably engage the insulating block 90 to the insulative housing 4. Stop blocks 98, 100 are included on the insulating block 90 which provide a positive stop with the recessed shoulders 18, 20 on the insulative housing. The stop blocks 98, 100 further prevent movement of the insulating block, ensuring that the insulating block 90 does not slide along the ratchet teeth 16, 96 to disengage the flat flexible cable from the modular jack.

Figure 4:
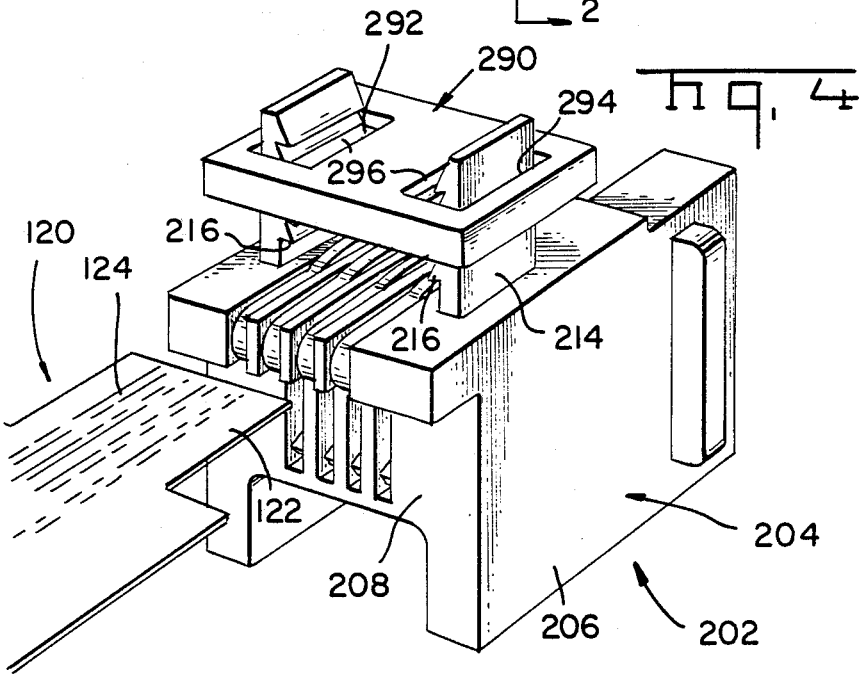
FIG. 4 is an isometric view of an alternate embodiment.

With reference to FIG. 4 an alternate embodiment is shown where the connector 202 includes a housing 204 and an insulating block 290. The housing 204 includes sidewalls 206, a front wall 208, and upstanding walls 214 having ratchet teeth 216. The insulating cap includes two openings 296 which are interior of the insulating cap 290. This allows edges 294 to contact the exterior surfaces of the sidewalls 214 to retain the sidewalls. This allows the sidewalls 214 to be of a thinner material and prevents the overstressing or plastic deformation of the sidewalls 214.

The invention was described by way of the preferred embodiments and should not be taken to limit the claims which follow.

We claim:

1. An electrical receptacle for interconnecting conductors of a first electrical medium to an electrical plug, where the plug is electrically interconnected to conductors of a multi-conductor cable, the receptacle including an insulative housing have a plug receiving opening and a surface for receiving the first said medium, the receptacle including electrical terminals having resilient contact portions for electrical interconnection to the plug and contact portions for interconnection to the conductors of the first medium, the receptacle being characterized in that:

the housing includes a top wall, a bottom wall, and two sidewalls, which collectively define the plug receiving opening therebetween, the top wall including a plurality of grooves therein, the receptacle being profiled for receiving flat flexible cable as the first said medium, the receptacle being modular in nature having the capability of connecting and disconnecting the plug and the flat flexible cable therefrom, and in that the electrical terminals include two integral resilient contact portions, the first resilient contact portions being reversely bent around the top wall and into the interior of the plug receiving opening for interconnection to the electrical plug and a second resilient contact portion being disposed within the said grooves for interconnection to the flat flexible cable.

2. The receptacle of claim 1 characterized in that the second resilient contact portions comprise cantilever spring portions which upstand above the flat flexible cable receiving surface.

3. An electrical connector for electrically interconnecting conductors of flat flexible cable to a plurality of second conductors, the connector including an insulative housing having a terminal receiving platform with a plurality of terminals aligned side-by-side along the platform for contact with the conductors of the flat flexible cable, the connector being characterized in that:

the terminal receiving platform of the insulative housing is profiled for receiving the conductors of the flat flexible cable towards a surface of the platform, and includes side-by-side grooves for receiving the terminals, the terminals each having a cantilever beam portion which projects above a surface of the platform for interconnection to respective facing conductors of the flat flexible cable; and in that the surface of the platform includes sidewalls upstanding therefrom and a moving means which includes an insulating block which is profiled to engageably fit between the sidewalls thereby holding the flat flexible cable in a fixed registration relative to the cantilever beam portions.

4. The electrical connector of claim 3 characterized in that the insulating block and sidewalls include complementary ratchet teeth for progressive locking arrangement in successive lowered positions.

5. An electrical connector having an insulative housing and a plurality of electrical terminals therein, the electrical terminals having resilient contact portions and conductor connecting portions, and an insulating block which is moveable towards the conductor connecting portions of the terminals to move conductors into electrical engagement therewith, the connector being characterized in that:

the housing includes a terminal support platform which houses the terminals in side by side arrangement therealong, the housing further including two sidewalls which upstand from the platform and flank the support platform, the sidewalls and the insulating block each including complementary ratchet teeth for progressive locking arrangement of the conductors with the conductor connecting portions.

6. The electrical connector of claim 5 characterized in that the housing is profiled to receive flat flexible cable conductors, the housing including a platform having a cable receiving surface having a plurality of grooves which receive the conductor connecting portions of the terminals.

7. The electrical connector of claim 6 characterized in that the conductor connecting portions are defined by cantilever beam portions, an upper contact area of which projects above the surface of the cable receiving surface.

* * * * *